US006804844B2

(12) United States Patent
Cushing

(10) Patent No.: US 6,804,844 B2
(45) Date of Patent: Oct. 19, 2004

(54) MATTRESS SHEET

(76) Inventor: Cheryl J. Cushing, 14046 Pleasant Valley Rd., South Beloit, IL (US) 61080

( * ) Notice: Subject to any disclaimer, the term of this patent is extended or adjusted under 35 U.S.C. 154(b) by 0 days.

(21) Appl. No.: 10/280,247

(22) Filed: Oct. 25, 2002

(65) Prior Publication Data

US 2004/0078898 A1 Apr. 29, 2004

(51) Int. Cl.[7] ..... A47G 9/04
(52) U.S. Cl. ..... 5/497; 5/498; 5/499
(58) Field of Search ..... 5/497, 496, 498, 5/499, 494, 402

(56) References Cited

U.S. PATENT DOCUMENTS 2,066,252 A * 12/1936 Cohen ..... 5/499
2,879,524 A * 3/1959 Elsen ..... 5/484
3,605,143 A * 9/1971 Smith ..... 5/499
5,323,501 A * 6/1994 Kuhangel ..... 5/499
5,642,540 A 7/1997 Culver et al.
6,067,677 A 5/2000 Reen et al.

* cited by examiner

*Primary Examiner*—Teri Pham Luu
*Assistant Examiner*—Fredrick Conley
(74) *Attorney, Agent, or Firm*—Leydig, Voit & Mayer, Ltd.

(57) ABSTRACT

A crib sheet that form fits on a mattress. The sheet comprises generally rectangular top and bottom portions that are spaced apart generally parallel when form fitted on the mattress. A sidewall portion extends around the periphery of the top and bottom portions to define four sides. The sidewall portion is generally perpendicular between the top and bottom panels when form fitted on the mattress. A mattress opening defined between lateral edges extends laterally through the sidewall portion. The mattress opening extends along the length one side and at least partially along two adjacent sides. Fasteners on the lateral edges surrounding the mattress opening are operable to open and securely close the mattress opening.

16 Claims, 4 Drawing Sheets

10
26
14
26
28
28
30
24
30
28
20
30
28
30
47
30
32
28
47
30
30
18
28
30
40
42
34
28
36
38
22
44
46
28
28
16

MATTRESS SHEET

FIELD OF THE INVENTION

This invention pertains to sheets for mattresses such as for beds, cribs or playpens and the like.

BACKGROUND OF THE INVENTION

Conventional crib sheets comprise a single sheet or panel of fabric covering the top of the crib mattress. The single sheet is held on the mattress by elastic sheet corners that fit snugly on the corners of the mattress. As described in U.S. Pat. No. 6,067,677 to Reen et al., this design has significant drawbacks, notably that the sheet can be pulled off by an infant and the infant can become entangled amidst the unraveled sheet. The '677 patent describes an attempt to encapsulate the crib mattress utilizing an elastic mattress entrance opening through the sheet and a Velcro flap that wraps over the opening and attaches to the bottom portion of the crib sheet. Another somewhat similar arrangement for a playpen mattress is shown in U.S. Pat. No. 5,642,540 which also has a flap that is secured to the bottom underside panel of the sheet. While these patents disclose various attempts to prevent unraveling of crib sheets, these patents have other drawbacks that have been discovered by the present inventor and which are remedied by the present invention.

BRIEF SUMMARY OF THE INVENTION

The present invention is directed toward a sheet adapted to be form fitted on a mattress that overcomes drawbacks existing in the prior art while also preventing unraveling of the sheet. The sheet comprises generally rectangular top and bottom portions that are spaced apart generally parallel when form fitted on the mattress. A sidewall portion extends around the periphery of the top and bottom portions to define four sides. The sidewall portion is generally perpendicular between the top and bottom panels when form fitted on the mattress. A mattress opening extends laterally through the sidewall portion and is defined between lateral edges. The mattress opening extends along the length one side and at least partially along two adjacent sides. Fasteners on the lateral edges surrounding the mattress opening are operable to open and securely close the mattress opening.

It is an advantage according to one aspect of the present invention that the bed sheet is reversible and either the top side or the bottom side may be used on the top surface of the mattress. In either position, the mattress opening and fastening mechanism therefore is still hidden at the side or end of the mattress. The reversibility feature is particularly advantageous for messes made by infants, because the mattress can simply be turned over to expose the clean bottom side along the top. It will be appreciated that this is particularly helpful for example in the middle of the night when it would be arduous and time consuming to completely remove soiled mattress sheet and replace it with a clean mattress sheet.

DETAILED DESCRIPTION OF THE INVENTION

Figure 1:
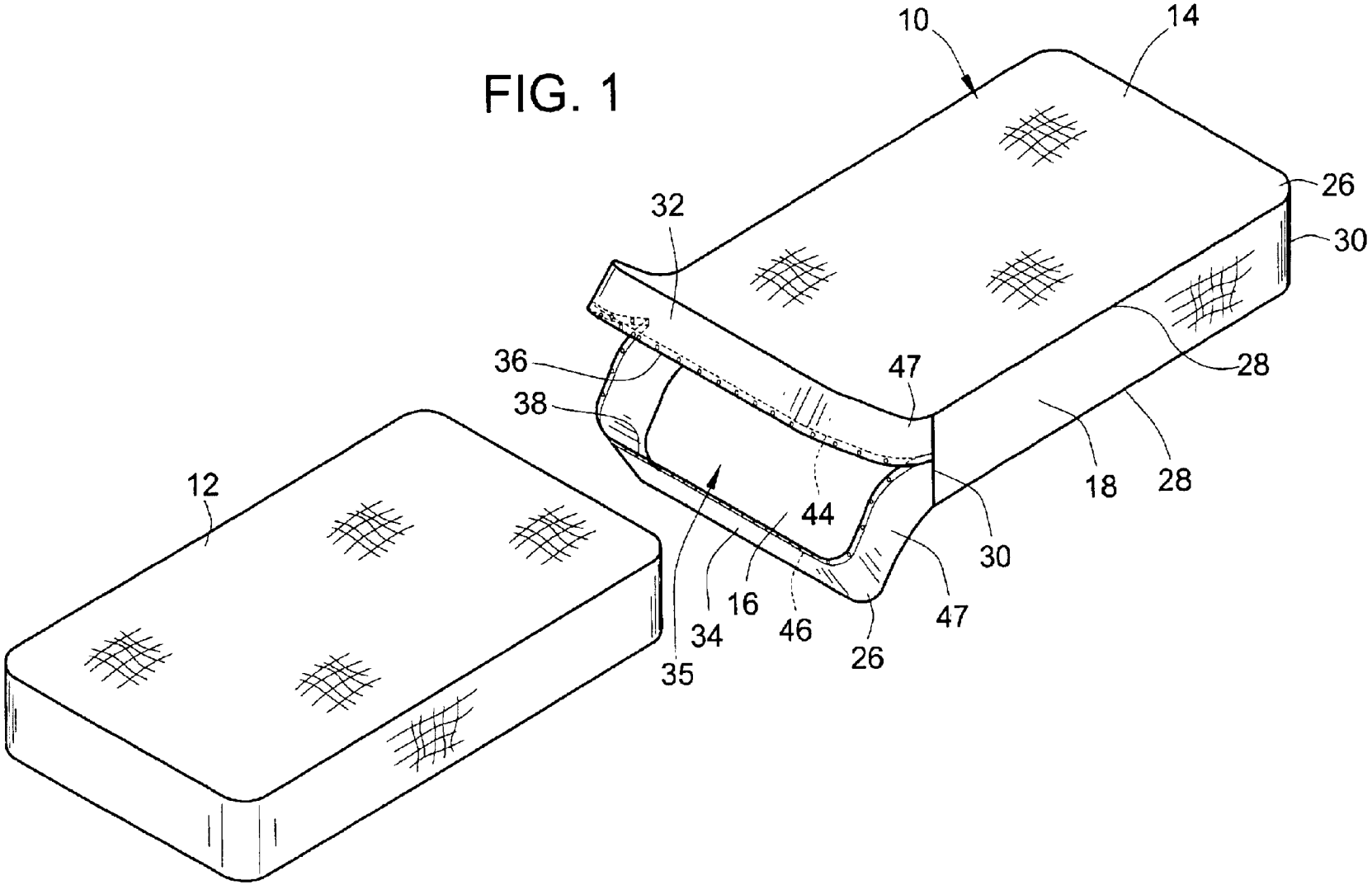
FIG. 1 is an exploded perspective view of a crib sheet according to a preferred embodiment of the present invention for a crib mattress.
Figure 1A:
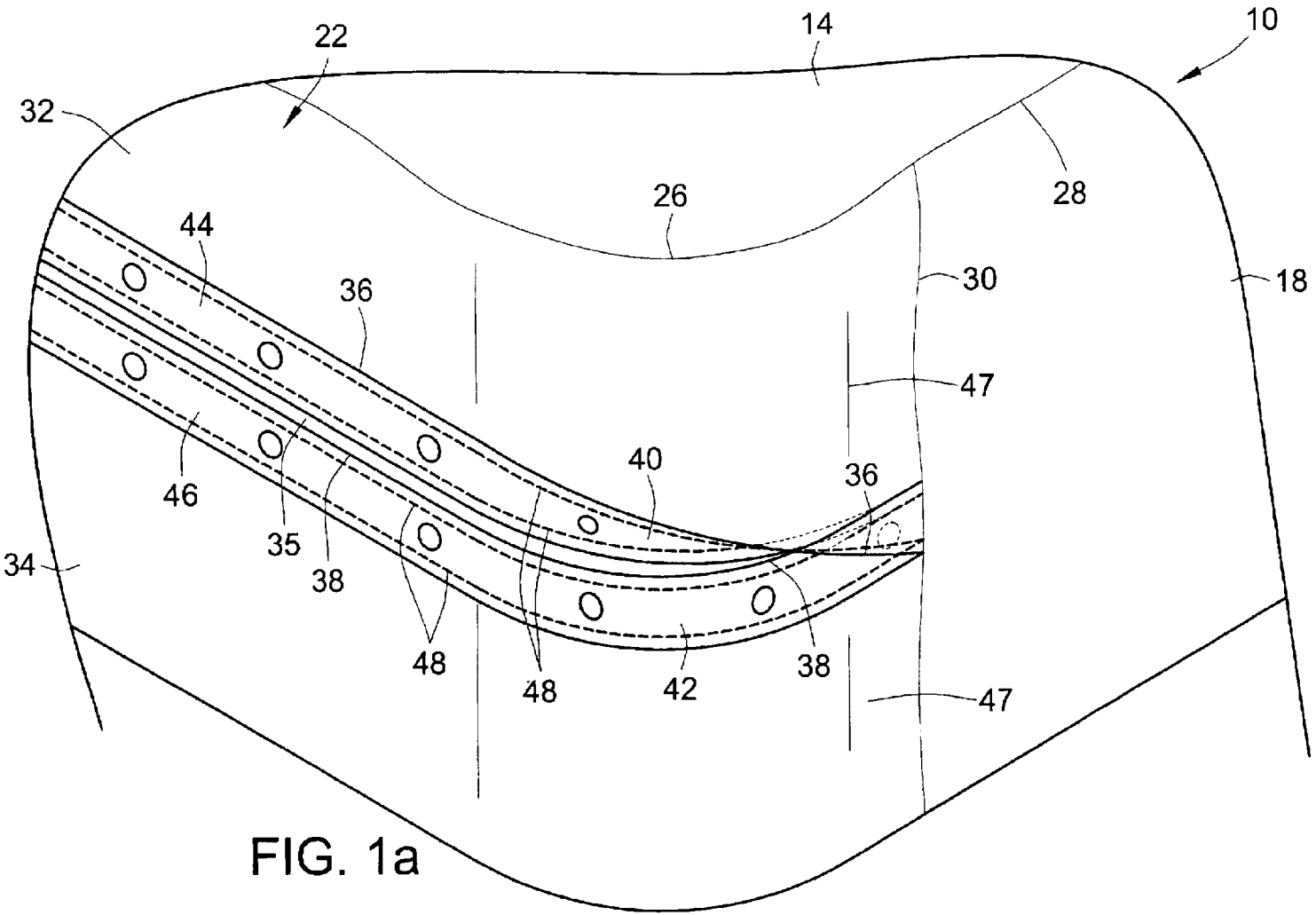
FIG. 1*a* is an enlarged view of a portion of FIG. 1.

A preferred embodiment of the present invention has been illustrated in the drawings as a crib sheet 10 for use with a crib mattress 12. In a preferred embodiment, the crib sheet 10 is made of flexible fabric material and is constructed from multiple panels that are cut preferably utilizing patterns.

Figure 3:
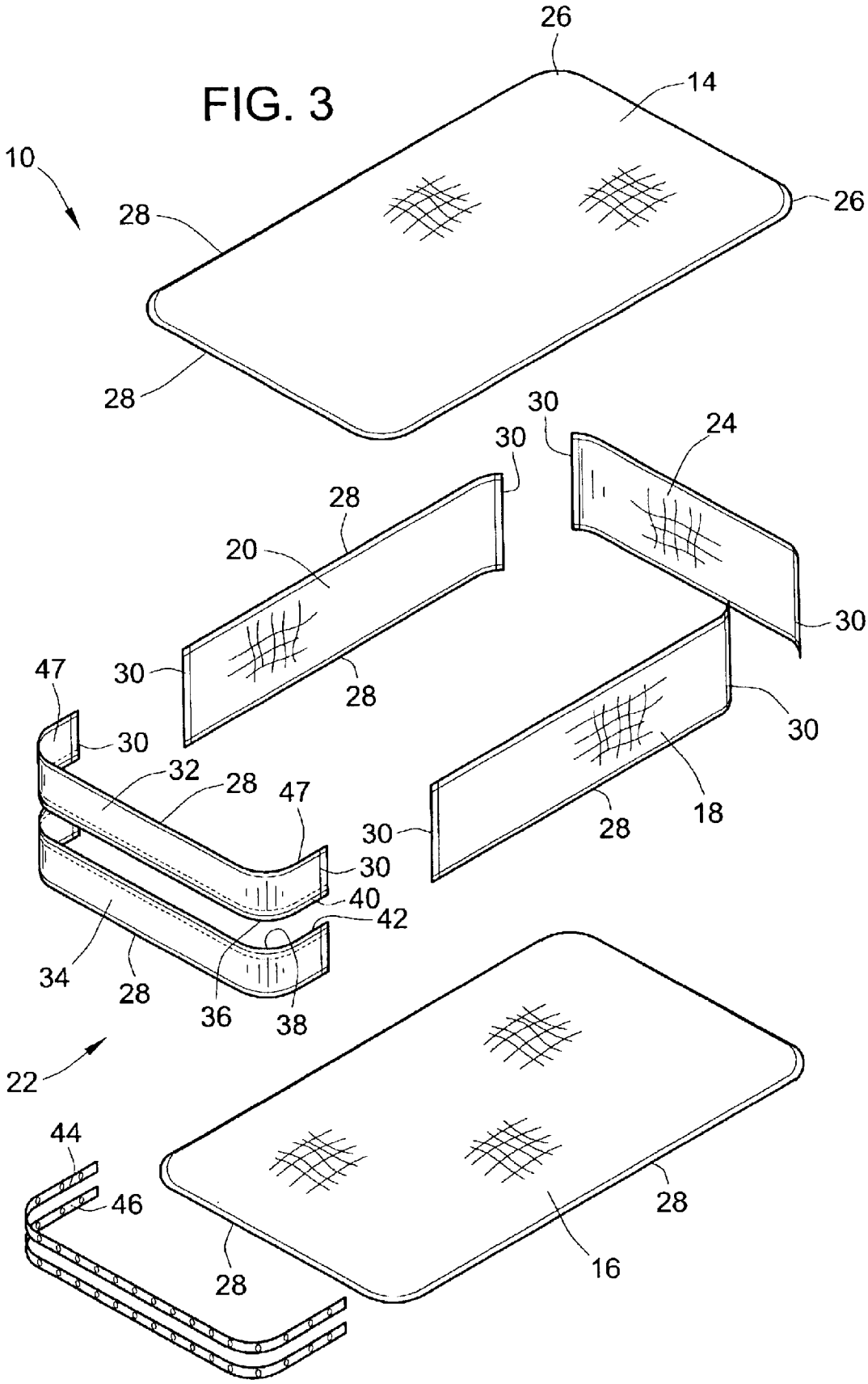
FIG. 3 is an exploded assembly drawing illustrating the various sheet panels of fabric material and how the sheet panels are sewn together.

As shown in FIG. 3, the crib sheet comprises many different cut fabric pieces that are sewn or otherwise secured together, including a top panel 14, a bottom panel 16, a pair of side panels 18, 20, and a pair of end panels 22, 24. As shown, the top and bottom panels 14, 16 are generally rectangular in shape and may have arcuate corners 26 that closely conform to the shape of the crib mattress 12. As shown in FIGS. 1 and 3, the side panels 18, 20 have top and bottom edges that are sewn to side edges on the top and bottom panels 14, 16 along horizontal stitch seams 28. The side panels 18, 20 extend generally perpendicular between the top and bottom panels 14, 16 when the sheet 10 is form fitted on the mattress 12. The end panels 22, 24 also have top and bottom edges that are sewn to end edges on the top and bottom panels 14, 16 along the horizontal stitch seams 28. The end panels 22, 24 have side edges that are sewn to corresponding side edges of the side panels 18, 20 along vertical seams 30. The end panels 22, 24 extend generally perpendicular between the bottom panels 14, 16 in a vertical direction and generally perpendicular between the side panels 18, 20 in a horizontal or lateral direction when the sheet 10 is form fitted on the mattress 12.

The construction of the sheet 10 described above provides the sheet with rectangular top and bottom portions and a vertical sidewall that transverses around the rectangular periphery of the top and bottom portions to define four different sides. It will be appreciated that the actual construction of the generally rectangular box shaped structure of the mattress sheet 10 can be made of more or fewer different cut pieces with stitch seams located in other locations, but such a construction still results in sidewall, top and bottom portions.

Figure 2:
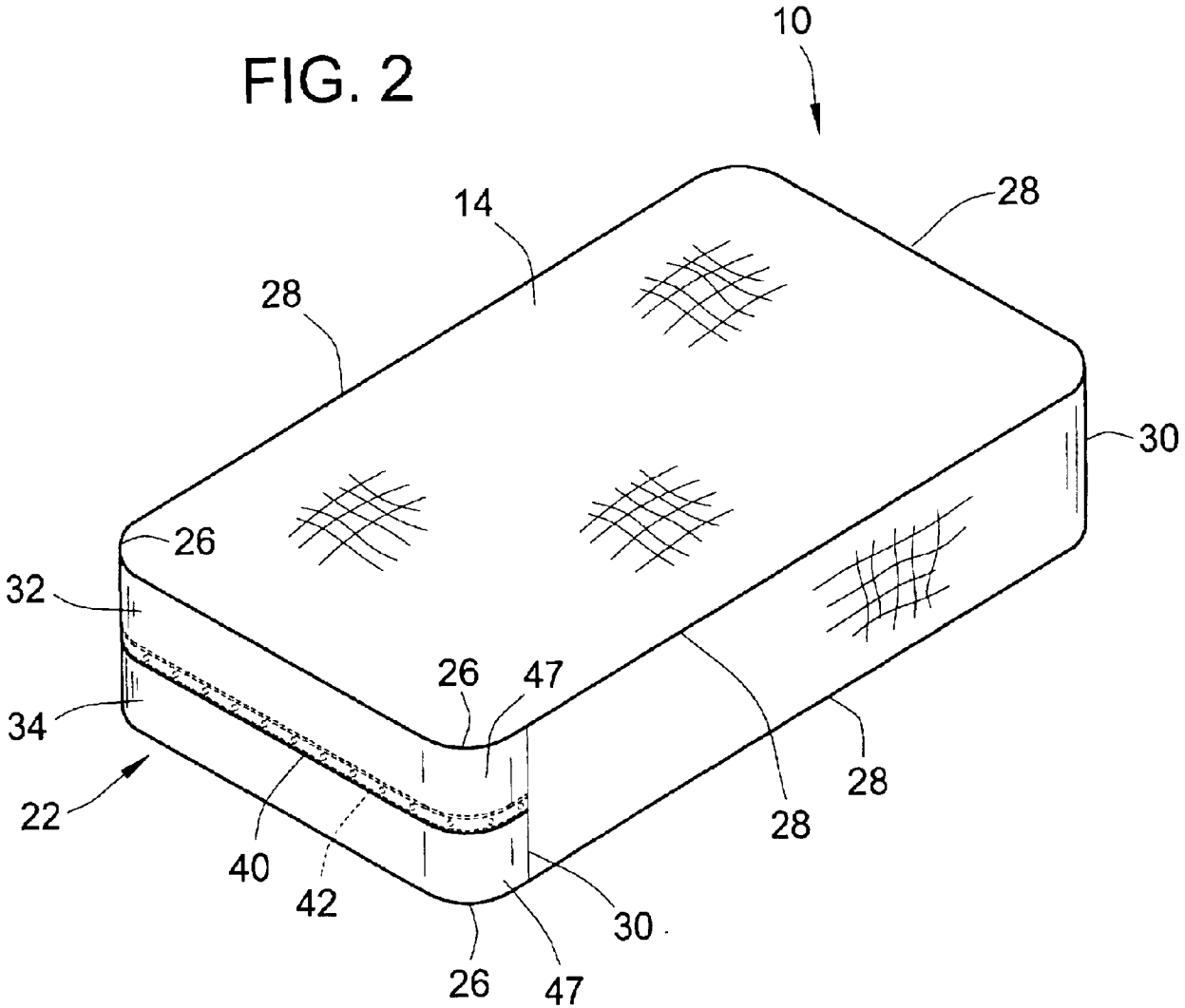
FIG. 2 is a perspective view of the crib sheet shown in FIG. 1 form fitted on a crib mattress.

As shown in FIG. 3, the first end panel 22 is cut apart along a lateral line to provide upper and lower segments 32, 34 to define a mattress opening 35 (FIG. 1) between upper and lower lateral edges 36, 38. The upper and lower lateral edges 36, 38 preferably overlap to provide overlapping flaps 40, 42 that may partially or fully conceal the mattress opening 35. Fasteners shown in the form of snap tape strips 44, 46 are provided along the upper and lower lateral edges 36, 38 and more specifically on the overlapping flaps 40, 42 to provide a means to open and close the mattress opening 35, as shown in FIGS. 1 and 2. The snap tape strips 44, 46 are sewn to the overlapping flaps 40, 42 along horizontal stitch seams 48. Although snap tape strips 44, 46 are shown as one form of fastener, it will be appreciated that other fasteners may be used including hook and loop fasteners, a Velcro strip, buttons/button openings, and/or zippers.

It is an aspect of the disclosed embodiment that the first end panel 24 and therefore also the mattress opening 35 extend around the two opposing corners 26 to form part of the two sides adjacent the end of the crib sheet 10. Specifically, the end panel 24 includes opposed lateral end portions 47 that wrap around the corners 26 (see e.g. FIG. 2). This provides the mattress opening 35 with sufficient size to allow for manually sliding of the mattress 12 through the mattress opening 35 when open as shown in FIG. 1. No elastic material is needed to make the opening 35 expandable or retractable and advantageously the sheet 10 may be free of elastic material. The mattress opening 35 is of a large enough size when open as shown in FIG. 1 such that it need not be expanded to insert or remove the mattress. This also allows the vertical seams 30 along the vertical edges of the first end panel 22 to stitch the overlapping flaps 40, 42 together and provide for a strong structure and a clean appearance.

An advantage of the disclosed embodiment is that the fastening strips 44, 46, the mattress opening 35 and the overlapping flaps 40, 42 are all provided along the sidewall between the top and bottom panels 14, 16. The top and bottom panels 14, 16 are therefore free of fastening devices and can both be used as a top surface for the mattress 12. This is particularly advantageous when an infant makes a mess, for example in the middle of the night. The mattress 12 and the sheet 10 form fitted thereon simply can be flipped over to provide the bottom panel 16 as the clean top surface, while the soiled top panel 14 is disposed along the bottom surface and therefore not in use.

Referring to FIG. 3, a preferred method of constructing the crib sheet 10 for a standard 52"×28"×5" or 6" thickness comprises first cutting the individual panels 14, 16, 18, 20, 22, 24 from fabric material such that:

a. the top and bottom panels 14, 16 are cut to 53"×29";

b. the side panels 18, 20 are cut to 49"×6.5";

c. the first end panel 22 is cut to 33"×10.25"; and d. the second end panel 24 is cut to 29"×6.5".

As evident from the dimensions above, the first end panel 22 may be cut to be larger vertically and horizontally than the second end panel 24, to allow sufficient fabric to provide for the oversized mattress opening 35 and securing of the fasteners strips 44, 46. The fastener tape (in which the individual strips 44, 46 are connected) is also cut to a length of 33".

The larger first end panel 22 is folded in half lengthwise and cut down the center to form two equal halves (e.g. the upper and lower segments 32, 34). Each segment 32, 34 is given a ¾ inch double hem along the cut side. One segment has the double hem facing up with the other segment having the double hem facing down (both double hems are face down if using a zipper). The individual strips 44, 46 of the fastener tape are then placed on each double-hemmed section of each segment 32, 34 and are stitched in place using a zipper foot. Once the tape (e.g. the individual strips 44, 46) is applied, the two segments 32, 34 are fastened together by closing the snaps on the snap strips 44, 46, thereby forming a complete section. The short ends are then stitched with a ½ inch seam allowance permanently securing the fastener of choice in place. This completes the first end panel 22 to provide for the mattress opening 35.

The opposed ends of the first end panel 22 are then stitched to each side panel 18, 20 along continuous vertical seams 30 (location of seam among adjacent parts being indicated in FIG. 3) with a ½ inch allowance. The smaller second end panel 24 is stitched to the side panels 18, 20 along additional vertical seams 30 at the side opposite the first end panel 22 with a ½ inch allowance. This completes and forms a unitary sidewall. The top edge of the sidewall is stitched to the top panel 14 along one horizontal seam 28 with a ½ inch seam allowance. The bottom edge of the sidewall is stitched to the bottom panel 16 along another horizontal seam 28 (location of seam among adjacent parts indicated in FIG. 3) with a ½ inch seam allowance. In stitching the sidewall and the top and bottom panels, the material is eased in around the arcuate corners 26.

The completed sheet 10 has measurements of 52"×28"×5.5". The sheet will fit the standard 52"×28" crib and toddler bed mattresses with either a 5" or a 6" thickness. Other dimensions may be used for other types of mattresses such as playpen mattresses or other bed mattresses where the features and advantages of the present invention are desired.

The examples discussed above further illustrate the invention but, of course, should not be construed as in any way limiting its scope. All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A sheet adapted to be form fitted on a mattress, comprising:

a generally rectangular top portion;

a generally rectangular bottom portion, the top and bottom portions being spaced apart generally parallel when form fitted on the mattress;

a sidewall portion extending around the periphery of the top and bottom portions to define four sides, the sidewall portion being generally perpendicular between the top and bottom portions when form fitted on the mattress;

a mattress opening defined between first and second lateral edges and extending laterally through the sidewall portion, the mattress opening extending along the length of a first one of said sides and at least partially along two sides adjacent to the first one of said sides;

first and second fasteners proximate the first and second lateral edges operable to open and securely close the mattress opening;

wherein the sidewall portion includes an end panel defining the mattress opening, the end panel having opposed lateral end portions wrapped around arcuate corners of the generally rectangular top and bottom portions, the end panel being cut laterally therethrough to provide upper and lower portions, the upper and lower portions including upper and lower overlapping flaps, the upper and lower overlapping flaps vertically overlapping each other when the first and second fasteners are fastened, wherein said fasteners comprise cooperating fastening strips secured to the overlapping flaps proximate the first and second lateral edges, respectively; and wherein the flaps are not integrally connected through material at any location, but instead are entirely separate disconnected pieces in which both laterally opposed ends of the upper and lower overlapping flaps are sewn together in overlapping relation.

2. The sheet of claim 1 wherein said fastening strips comprise button snaps adapted to be snapped and unsnapped together.

3. The sheet of claim 1 wherein the opposed lateral end portions wrap around the arcuate corners sufficiently to provide the mattress opening with sufficient size to allow for manually sliding of the mattress through the mattress opening when open.

4. The sheet of claim 3 wherein the top and bottom portions are free of any opening and free of any fasteners such that the sheet is reversible to allow either the top portion or the bottom portion to be slept upon.

5. The sheet of claim 1 wherein the top and bottom portions are free of any opening and free of any fasteners such that the sheet is reversible to allow either the top portion or the bottom portion to be slept upon.

6. The sheet of claim 1 wherein the sheet is free of elastic material.

7. A crib sheet constructed of fabric material and adapted to be form fitted on a generally rectangular crib mattress, the crib sheet comprising:

a generally rectangular top panel having arcuate corners;

a generally rectangular bottom panel having arcuate corners;

a pair of side panels having opposing edges sewn to the top and bottom panels along horizontal seams, the side panels extending generally perpendicular between the top and bottom panels when form fitted on the crib mattress;

a first and second end panels, the end panels having first opposing edges sewn to the top and bottom panels along horizontal seams and second opposing edges sewn to the side panels along vertical seams, the end panels extending generally perpendicular between the top and bottom panels and generally perpendicular between the side panels when form fitted on the crib mattress;

a mattress opening defined through a lateral cut through the first end panel, the mattress opening splitting the first end panel into upper and lower panels, the upper and lower panels including overlapping flaps, wherein the flaps are not integrally connected through material at any location, but instead are entirely separate disconnected pieces in which both laterally opposed ends of the upper and lower overlapping flaps are sewn together in overlapping relation;

a pair of fastening strips sewn to the overlapping flaps respectively, the fastening strips including cooperating fasteners operable to open and securely close the mattress opening; and wherein the first end panel has opposed lateral end portions of the first end panel wrapped around the arcuate corners of the generally rectangular top and bottom portions such that the mattress opening wraps around the arcuate corners and is sufficiently large to allow for sliding insertion and removal of the mattress through the mattress opening.

8. The crib sheet of claim 7 wherein the first end panel is longer laterally than the second end panel.

9. The crib sheet of claim 8 wherein the first end panel includes more fabric material vertically than the second end panel.

10. The crib sheet of claim 7 wherein the top and bottom portions are free of any opening and free of any fasteners such that the sheet is reversible to allow either the top portion or the bottom portion to be slept upon.

11. The crib sheet of claim 7 wherein said fastening strips comprise button snaps adapted to be snapped and unsnapped together.

12. The crib sheet of claim 7 wherein the crib sheet is free of elastic material.

13. A sheet adapted to be form fitted on a mattress, comprising:

a generally rectangular top portion;

a generally rectangular bottom portion, the top and bottom portions being spaced apart generally parallel when form fitted on the mattress;

a sidewall portion extending around the periphery of the top and bottom portions to define four sides, the sidewall portion being generally perpendicular between the top and bottom portions when form fitted on the mattress;

a mattress opening defined between first and second lateral edges and extending laterally through the sidewall portion, the mattress opening extending along the length of a first one of said sides and at least partially along two sides adjacent to the first one of said sides;

first and second fasteners proximate the first and second lateral edges operable to open and securely close the mattress opening, wherein said fasteners comprise button snaps adapted to be snapped and unsnapped together;

wherein the button snaps are interposed between the first and second lateral edges such that the upper and lower portions include upper and lower overlapping flaps, the upper and lower overlapping flaps vertically overlapping each other when the first and second fasteners are fastened; and wherein the flaps are not integrally connected through material at any location, but instead are entirely separate disconnected pieces in which both laterally opposed ends of the upper and lower overlapping flaps are sewn together in overlapping relation.

14. The sheet of claim 13, wherein the sidewall portion includes an end panel defining the mattress opening, the end panel being cut laterally therethrough to provide upper and lower portions with the mattress opening therebetween, wherein the end panel is sufficiently long to provide the mattress opening with sufficient size to allow for manually sliding of the mattress through the mattress opening when open.

15. The sheet of claim 14 wherein the top and bottom portions are free of any opening and free of any fasteners such that the sheet is reversible to allow either the top portion or the bottom portion to be slept upon.

16. The sheet of claim 15 wherein the sheet is free of elastic material.

* * * * *